US008803927B2

(12) United States Patent
Wu et al.

(10) Patent No.: US 8,803,927 B2
(45) Date of Patent: Aug. 12, 2014

(54) PIXEL CIRCUIT AND FLAT DISPLAY PANEL USING THE SAME

(75) Inventors: Yu-Ching Wu, Hsin-Chu (TW); Tien-Lun Ting, Hsin-Chu (TW); Kun-Cheng Tien, Hsin-Chu (TW); Chien-Huang Liao, Hsin-Chu (TW); Wen-Hao Hsu, Hsin-Chu (TW)

(73) Assignee: Au Optronics Corp., Hsinchu (TW)

( * ) Notice: Subject to any disclaimer, the term of this patent is extended or adjusted under 35 U.S.C. 154(b) by 258 days.

(21) Appl. No.: 13/344,681

(22) Filed: Jan. 6, 2012

(65) Prior Publication Data

US 2012/0320099 A1 Dec. 20, 2012

(30) Foreign Application Priority Data

Jun. 15, 2011 (TW) ..... 100120957 A

(51) Int. Cl.
*G09G 3/34* (2006.01)
*G09G 3/36* (2006.01)

(52) U.S. Cl.
USPC ..... 345/690; 345/104

(58) Field of Classification Search
None
See application file for complete search history.

(56) References Cited

U.S. PATENT DOCUMENTS

| | | | | |
|---|---|---|---|---|
| 7,173,676 | B2 * | 2/2007 | Jeon et al. | 349/48 |
| 7,944,424 | B2 | 5/2011 | Tsao et al. | |
| 2006/0164352 | A1 | 7/2006 | Yoo et al. | |
| 2006/0290827 | A1 | 12/2006 | Kihara et al. | |
| 2007/0001954 | A1 | 1/2007 | Shishido et al. | |
| 2008/0211983 | A1 | 9/2008 | Tsao et al. | |
| 2009/0027581 | A1 | 1/2009 | You et al. | |
| 2010/0220116 | A1 | 9/2010 | Liao et al. | |
| 2010/0265230 | A1 * | 10/2010 | Kang | 345/211 |
| 2011/0181804 | A1 | 7/2011 | You et al. | |

FOREIGN PATENT DOCUMENTS

| | | |
|---|---|---|
| CN | 1811535 | 8/2006 |
| CN | 1892775 | 1/2007 |
| CN | 101354512 | 1/2009 |
| TW | 201031982 | 9/2010 |

OTHER PUBLICATIONS

Taiwan Patent Office, "Office Action", Sep. 23, 2013.

* cited by examiner

*Primary Examiner* — Amr Awad
*Assistant Examiner* — Donna Lui
(74) *Attorney, Agent, or Firm* — WPAT, PC; Justin King

(57) ABSTRACT

An exemplary pixel circuit and a flat display panel using the same are provided. The pixel circuit includes three sub-electrode control circuits. The sub-electrode control circuits are controlled by two scan lines to receive data transmitted from two data lines. One of the three sub-electrode control circuits adjusts stored data by charge sharing. Accordingly, a display control of the pixel circuit is achieved by the three sub-electrode control circuits.

11 Claims, 4 Drawing Sheets

PIXEL CIRCUIT AND FLAT DISPLAY PANEL USING THE SAME

TECHNICAL FIELD

The disclosure relates to pixel circuits and flat display panels using the same, and more particularly to a pixel circuit that is capable of improving the color washout phenomenon appeared under side view angles of flat display panels and a flat display panel using the same.

BACKGROUND

Nowadays, liquid crystal display (LCD) devices are a kind of widely used flat display device. According to different driving modes, LCD devices can be divided into three kinds of twisted nematic (TN) LCD device, vertical alignment (VA) LCD device and In Plane Switching (IPS) LCD device.

The TN LCD device is the firstly developed kind of LCD device. Advantages of such TN LCD device are that it is cheaper and has higher response rate. However, a view angle range of the TN LCD device is narrow. Compared with the TN LCD device, the VA LCD device and the IPS LCD device can provide wider view angle ranges, and therefore become preferred driving modes for display devices with large screens.

However, although the VA LCD device has wider view angle than the TN LCD device, the VA LCD device generally has a drawback that it may generate color washout at its side view angles. In order to overcome the drawback, a conventional method generally is to divide each pixel circuit of an LCD device into two sub-pixels and use suitable circuit designs to make pixel voltages of the two sub-pixels to be different from each other so as to cause the two sub-pixels to generate different luminance. However, referring to FIG. 1, the aforementioned conventional method can effectively limit luminance of the sub-pixels to be about gamma 2.2 only at certain grey levels. It is obvious that such an improving effect is not satisfactory. Therefore, many researchers are still dedicating themselves to relevant researches for improving color washout phenomenon generated at side view angles of flat display panels.

SUMMARY OF EMBODIMENTS

Accordingly, an embodiment of the disclosure provides a pixel circuit electrically coupled to successively arranged a first data line and a second data line and further electrically coupled to successively arranged a first scan line and a second scan line. The pixel circuit includes a first sub-electrode control circuit, a second sub-electrode control circuit and a third sub-electrode control circuit. The first sub-electrode control circuit is electrically coupled to the first data line and the first scan line. The first sub-electrode control circuit is for receiving data transmitted from the first data line and thereby controlling transparency of a first pixel area according to the received data from the first data line. The second sub-electrode control circuit is electrically coupled to the second data line and the first scan line. The second sub-electrode control circuit is for receiving data transmitted from the second data line and thereby controlling transparency of a second pixel area according to the received data from the second data line. The third sub-electrode control circuit is electrically coupled to the second data line, the first scan line and the second scan line. The third sub-electrode control circuit is for receiving the data transmitted from the second data line, changing the received data from the second data line by charge sharing subjected to the control of the second scan line and thereby controlling transparency of a third pixel area according to the changed data. Moreover, a time of the second scan line being enabled is posterior to a time of the first scan line being enabled.

Another embodiment of the disclosure provides a flat display panel including multiple scan lines, multiple data lines and multiple pixel circuits. At least one of the pixel circuits each is electrically coupled to a first data line and a second data line arranged adjacent to the first data line among the multiple data lines and further electrically coupled to a first scan line and a second scan line arranged adjacent to the first scan line among the multiple scan lines. The at least one pixel circuit each includes a first sub-electrode control circuit, a second sub-electrode control circuit and a third sub-electrode control circuit. The first sub-electrode control circuit is electrically coupled to the first data line and the first scan line. The first sub-electrode control circuit is for receiving data transmitted from the first data line and controlling transparency of a first pixel area according to the received data from the first data line. The second sub-electrode control circuit is electrically coupled to the second data line and the first scan line and for receiving data transmitted from the second data line and controlling transparency of a second pixel area according to the received data from the second data line. The third sub-electrode control circuit is electrically coupled to the second data line, the first scan line and the second scan line and for receiving the data transmitted from the second data line, changing the received data from the second data line by charge sharing subjected to the control of the second scan line and thereby controlling transparency of a third pixel area according to the changed data. Moreover, the second scan line and the first scan line are sequentially enabled, and the second scan line is enabled after the first scan line is enabled.

BRIEF DESCRIPTION OF THE DRAWINGS

The above embodiments of the disclosure will become more readily apparent to those ordinarily skilled in the art after reviewing the following detailed description and accompanying drawings.

DETAILED DESCRIPTION OF EMBODIMENTS

The disclosure will now be described more specifically with reference to the following embodiments. It is to be noted that the following descriptions of preferred embodiments are presented herein for purpose of illustration and description only. It is not intended to be exhaustive or to be limited to the precise form disclosed.

Figure 2:
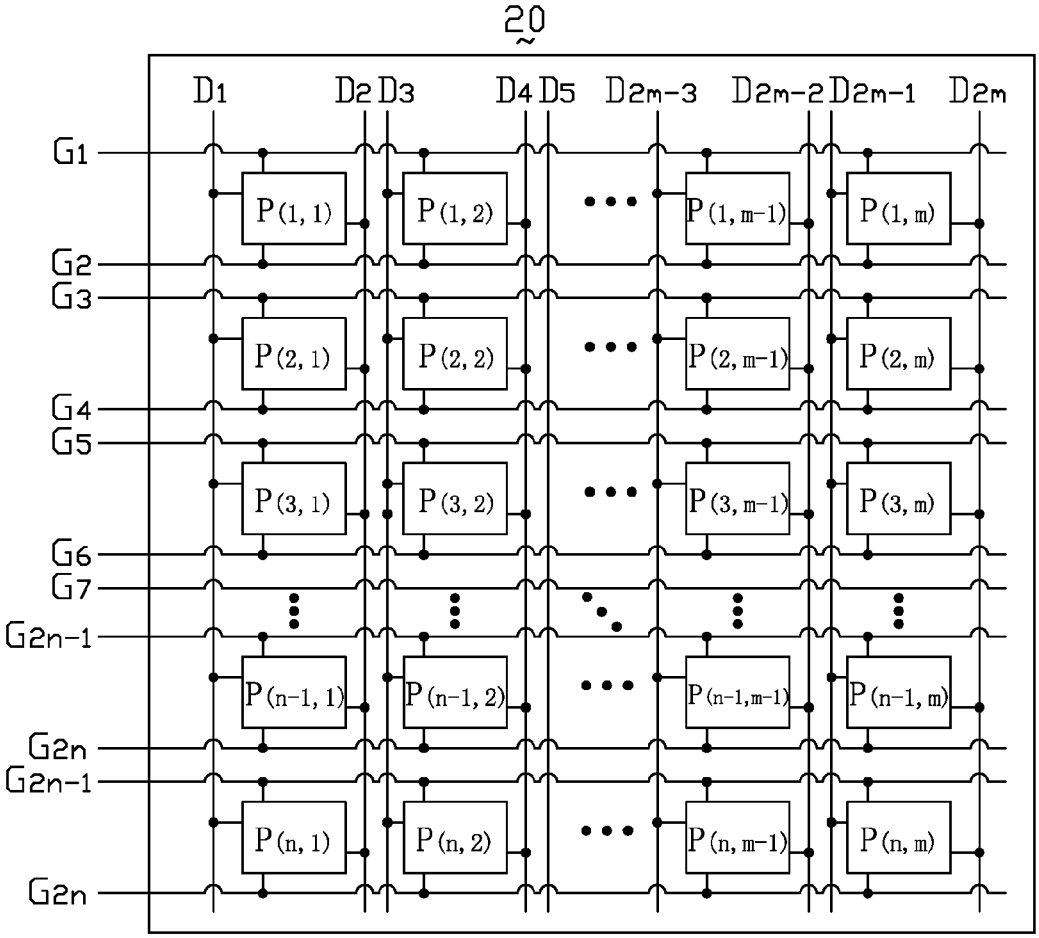
FIG. 2 is a schematic block diagram of a flat display panel according to an exemplary embodiment of the disclosure.

Referring to FIG. 2, FIG. 2 is a schematic block diagram of a flat display panel 20 according to an exemplary embodiment of the disclosure. In this embodiment, the flat display panel 20 includes multiple scan lines e.g., $G_1, G_2, \ldots, G_{2n-1}$, and $G_{2n}$, multiple data lines e.g., $D_1, D_2, D_3, \ldots D_{2m-1}$, and $D_{2m}$, and multiple pixel circuits e.g., $P_{(1,1)}, P_{(1,2)}, \ldots$, and $P_{(n,m)}$. In detail, the pixel circuit $P_{(X,Y)}$ means the pixel circuit located at Xth row and Yth column. For example, the pixel circuits in the first row are respectively labeled as $P_{(1,1)}, P_{(1,2)}, \ldots$, and $P_{(1,m)}$; the pixel circuits in the nth row are respectively labeled as $P_{(n,1)}, P_{(n,2)}, \ldots$, and $P_{(n,m)}$. Similarly, the pixel circuits in the first column are respectively labeled as $P_{(1,1)}, P_{(2,1)}, P_{(3,1)}, \ldots$, and $P_{(n,1)}$; the pixel circuits in the second column are respectively labeled as $P_{(1,2)}, P_{(2,2)}, P_{(3,2)}, \ldots$, and $P_{(n,2)}$; and the pixel circuits in the mth column are respectively labeled as $P_{(1,m)}, P_{(2,m)}, P_{(3,m)}, \ldots$, and $P_{(n,m)}$.

As shown in FIG. 2, each of the pixel circuits $P_{(1,1)}, P_{(1,2)}, \ldots$, and $P_{(n,m)}$ is electrically coupled to adjacent two of the scan lines $G_1, G_2, \ldots, G_{2n-1}$, and $G_{2n}$ and adjacent two of the data lines $D_1, D_2, D_3, \ldots D_{2m-1}$, and $D_{2m}$. For example, the pixel circuit $P_{(1,1)}$ is electrically coupled to the successively arranged scan lines $G_1$, $G_2$ and the successively arranged data lines $D_1$, $D_2$; and the pixel circuit $P_{(2,1)}$ is electrically coupled to the successively arranged scan lines $G_3$, $G_4$ and the successively arranged data lines $D_1$, $D_2$. An operation relationship among the scan lines and the data lines of any one of the pixel circuits electrically coupled thereto will be described in detail as follows.

Figure 3:
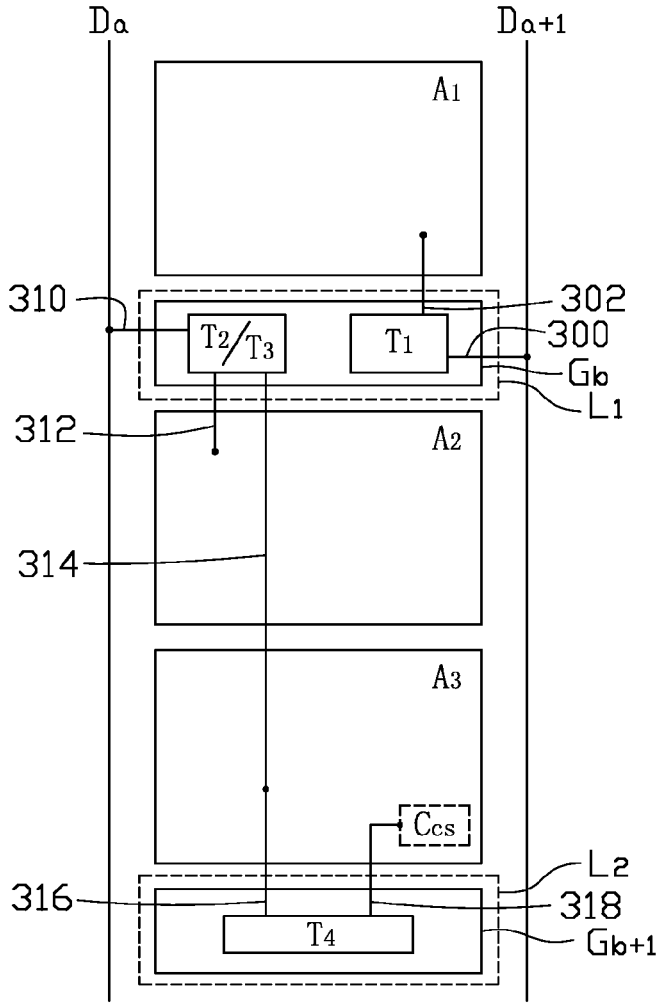
FIG. 3 is a schematic block diagram of a pixel circuit according to an exemplary embodiment of the disclosure.

Referring to FIG. 3, FIG. 3 is a schematic block diagram of any one of the aforementioned pixel circuits $P_{(1,1)}, P_{(1,2)}, \ldots$, and $P_{(n,m)}$ according to an exemplary embodiment of the disclosure. As shown in FIG. 3, the pixel circuit includes three pixel areas $A_1$, $A_2$ and $A_3$, two wiring areas $L_1$ and $L_2$, multiple transistors $T_1$, $T_2$, $T_3$ and $T_4$, a charge sharing capacitor $C_{CS}$, and multiple conductive wires 300, 302, 310, 312, 314, 316 and 318. The transistors $T_1$, $T_2$ and $T_3$ are arranged in the wiring area $L_1$, and the transistor $T_4$ is arranged in the wiring area $L_2$. The pixel circuit in FIG. 3 is electrically coupled to two adjacent data lines $D_a$ and $D_{a+1}$ and two adjacent scan lines $G_b$ and $G_{b+1}$. Additionally, a scanning order of scan line is that the scan line $G_{b+1}$ is enabled after the scan line $G_b$ has already been enabled. That is, the time of the scan line $G_{b+1}$ being enabled is posterior to the time of the scan line $G_b$ being enabled. Furthermore, the pixel areas $A_1$, $A_2$ and $A_3$ are all arranged between the data lines $D_a$ and $D_{a+1}$. The pixel areas $A_1$ and $A_2$ are respectively arranged at two sides of the scan line $G_b$. The pixel areas $A_2$ and $A_3$ both are arranged between the scan lines $G_b$ and $G_{b+1}$.

In this embodiment, the pixel circuit includes three sub-electrode control circuits, i.e., a first sub-electrode control circuit, a second sub-electrode control circuit and a third sub-electrode control circuit. The first sub-electrode control circuit of the pixel circuit is defined as to include the transistor $T_1$ and the conductive wires 300, 302. The transistor $T_1$ is electrically coupled to the data line $D_{a+1}$ through the conductive wire 300. The scan line $G_b$ controls the transistor $T_1$ to determine whether to receive data transmitted from the data line $D_{a+1}$ or not. Data received by the transistor $T_1$ is inputted to the first sub-electrode control circuit through the conductive wire 302 and stored in the first sub-electrode control circuit. Generally, the data received by the transistor $T_1$ can be stored in a capacitor (not shown) arranged in the pixel area $A_1$ or at an edge of the pixel area $A_1$ and an electric potential is representative of the stored data in the first sub-electrode control circuit. Transparency of the pixel area $A_1$ is affected by a electric potential difference between the electric potential of the stored data and a common electric potential of the flat display panel 20. In other words, because the common electric potential of the flat display panel 20 is usually fixed at a certain period, the first sub-electrode control circuit can be regarded as to control the transparency of the pixel area $A_1$ according to the received data from the data line $D_{a+1}$.

Similarly, the second sub-electrode control circuit of the pixel circuit is defined as to include the transistor $T_2$ and the conductive wires 310, 312. The transistor $T_2$ is electrically coupled to the data line $D_a$ through the conductive wire 310. The scan line $G_b$ controls the transistor $T_2$ to determine whether to receive data transmitted from the data line $D_a$ or not. Data received by the transistor $T_2$ is inputted to the second sub-electrode control circuit through the conductive wire 312 and stored in the second sub-electrode control circuit. Generally, the data received by the transistor $T_2$ can be stored in a capacitor (not shown) arranged in the pixel area $A_2$ or at an edge of the pixel area $A_2$. Similar to that of the pixel area $A_1$, the second sub-electrode control circuit can be regarded as to control transparency of the pixel area $A_2$ according to the received data from the data line $D_a$.

The third sub-electrode control circuit of the pixel circuit is defined as to include the transistors $T_3$ and $T_4$, the charge sharing capacitor $C_{CS}$ and the conductive wires 310, 314, 316 and 318. The transistor $T_3$ is electrically coupled to the data line $D_a$ through the conductive wire 310. The scan line $G_b$ controls the transistor $T_3$ to determine whether to receive data transmitted from the data line $D_a$ or not. Data received by the transistor $T_3$ is inputted to the third sub-electrode control circuit through the conductive wire 314 and stored in the third sub-electrode control circuit. Generally, the data received by the transistor $T_3$ can be stored in a capacitor (not shown) arranged in the pixel area $A_3$ or at an edge of the pixel area $A_3$. Furthermore, the scan line $G_{b+1}$ which is enabled after the scan line $G_b$ is enabled controls the transistor $T_4$ to be turned on or off. When the transistor $T_4$ is turned on, the electric potential of the data stored in the third sub-electrode control circuit may be changed because the capacitor stored with the received data and the charge sharing capacitor $C_{CS}$ may share charges with each other through the conductive wires 316 and 318. Therefore, the third sub-electrode control circuit can be regarded as to control transparency of the pixel area $A_3$ according to the data stored in the third sub-electrode control circuit. However, at different times, the aforementioned "data stored in the third sub-electrode control circuit" may be an electric potential of data just received from the data line $D_a$ and stored in the third sub-electrode control circuit, or an electric potential of data that is stored in the third sub-electrode control circuit after charge sharing.

Figure 4:
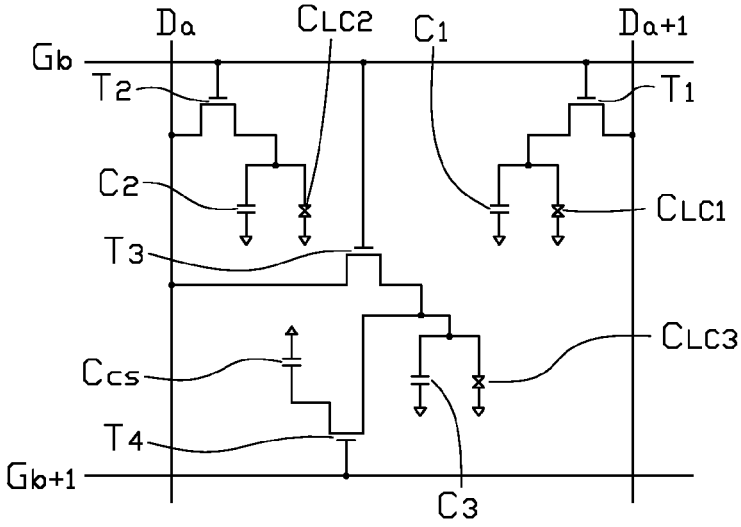
FIG. 4 is a schematic circuit diagram of a pixel circuit according to an exemplary embodiment of the disclosure.

Referring to FIG. 4, FIG. 4 is a schematic circuit diagram of any one of the aforementioned pixel circuits according to an exemplary embodiment of the disclosure. On the whole, FIG. 4 can be regarded as an equivalent circuit diagram of the pixel circuit shown in FIG. 3, except that FIG. 4 shows some elements that are not shown in FIG. 3.

In the pixel circuit shown in FIG. 4, the first sub-electrode control circuit includes the transistor $T_1$ and further includes a storage capacitor $C_1$ and a liquid crystal capacitor $C_{LC1}$. The liquid crystal capacitor $C_{LC1}$ is an equivalent representation of capacitance effect generated by positioning liquid crystal molecules between a positive electrode and a negative electrode. The transistor $T_1$ is electrically coupled to one of the positive electrode and the negative electrode, hereinafter also referred to as first sub-electrode. The transistor $T_1$ is further electrically coupled between the data line $D_{a+1}$ and the storage capacitor $C_1$. The transistor $T_1$ is still further electrically coupled to the scan line $G_b$ and controlled to be turned on or off by an electric potential on the scan line $G_b$. Furthermore, the transistor $T_1$ is also electrically coupled between the data line $D_{a+1}$ and the liquid crystal capacitor $C_{LC1}$. Therefore, once the transistor $T_1$ is turned on, data transmitted from the data line $D_{a+1}$ (i.e., an electric potential on the data line $D_{a+1}$) is temporarily stored in the storage capacitor $C_1$ and the liquid crystal capacitor $C_{LC1}$.

The second sub-electrode control circuit includes the transistor $T_2$, a storage capacitor $C_2$ and a liquid crystal capacitor $C_{LC2}$, and has an operation process similar to that of the first sub-electrode control circuit. The transistor $T_2$ is electrically coupled between the data line $D_a$ and the storage capacitor $C_2$. The transistor $T_2$ is further electrically coupled to the scan line $G_b$ and controlled to be turned on or off by the electric potential on the scan line $G_b$. Furthermore, the transistor $T_2$ is also electrically coupled between the data line $D_a$ and the liquid crystal capacitor $C_{LC2}$. That is, one terminal of the transistor $T_2$ is electrically coupled to an electrode of the liquid crystal capacitor $C_{LC2}$, hereinafter referred to as second sub-electrode. Therefore, once the transistor $T_2$ is turned on, the data transmitted from the data line $D_a$ is temporarily stored in the storage capacitor $C_2$ and the liquid crystal capacitor $C_{LC2}$.

In the embodiment shown in FIG. 4, the third sub-electrode control circuit includes the transistors $T_3$ and $T_4$, a storage capacitor $C_3$, a liquid crystal capacitor $C_{LC3}$ and the charge sharing capacitor $C_{CS}$. The transistor $T_3$ is electrically coupled between the data line $D_a$ and the storage capacitor $C_3$. The transistor $T_3$ is further electrically coupled to the scan line $G_b$ and controlled to be turned on or off by the electric potential on the scan line $G_b$. Furthermore, the transistor $T_3$ is also electrically coupled between the data line $D_a$ and the liquid crystal capacitor $C_{LC3}$. That is, one terminal of the transistor $T_3$ is electrically coupled to an electrode of the liquid crystal capacitor $C_{LC3}$, hereinafter referred to as third sub-electrode. Therefore, once the transistor $T_3$ is turned on, the data transmitted from the data line $D_a$ is temporarily stored in the storage capacitor $C_3$ and the liquid crystal capacitor $C_{LC3}$. The transistor $T_4$ is electrically coupled between the storage capacitor $C_3$ and the charge sharing capacitor $C_{CS}$. The transistor $T_4$ is further electrically coupled to the scan line $G_{b+1}$ and controlled to be turned on or off by the electric potential on the scan line $G_{b+1}$. Furthermore, the transistor $T_4$ is also electrically coupled between the charge sharing capacitor $C_{CS}$ and the liquid crystal capacitor $C_{LC3}$; that is, one terminal of the transistor $T_4$ is electrically coupled to the third sub-electrode. Once the transistor $T_4$ is turned on, the storage capacitor $C_3$, the liquid crystal capacitor $C_{LC3}$ and the charge sharing capacitor $C_{CS}$ can share charges with each other, and thus electric potentials of the storage capacitor $C_3$ and the liquid crystal capacitor $C_{LC3}$ would be changed consequently.

Figure 1:
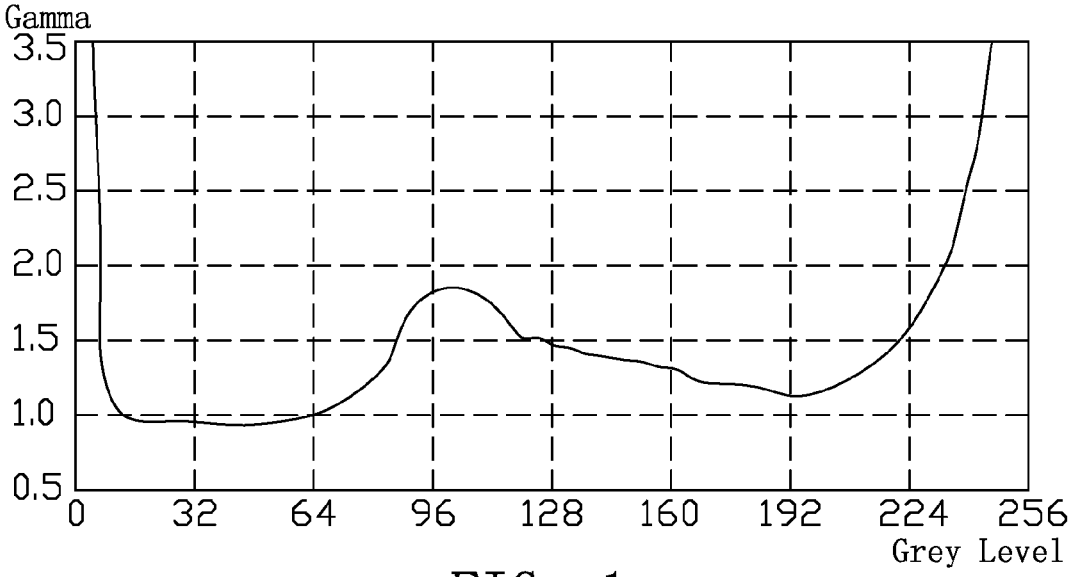
FIG. 1 (Related Art)
FIG. 1 is a curve diagram of a relationship between luminance and grey levels at 45 degrees side view angle of a flat display panel using a conventional method of improving color washout phenomenon.
Figure 5A:
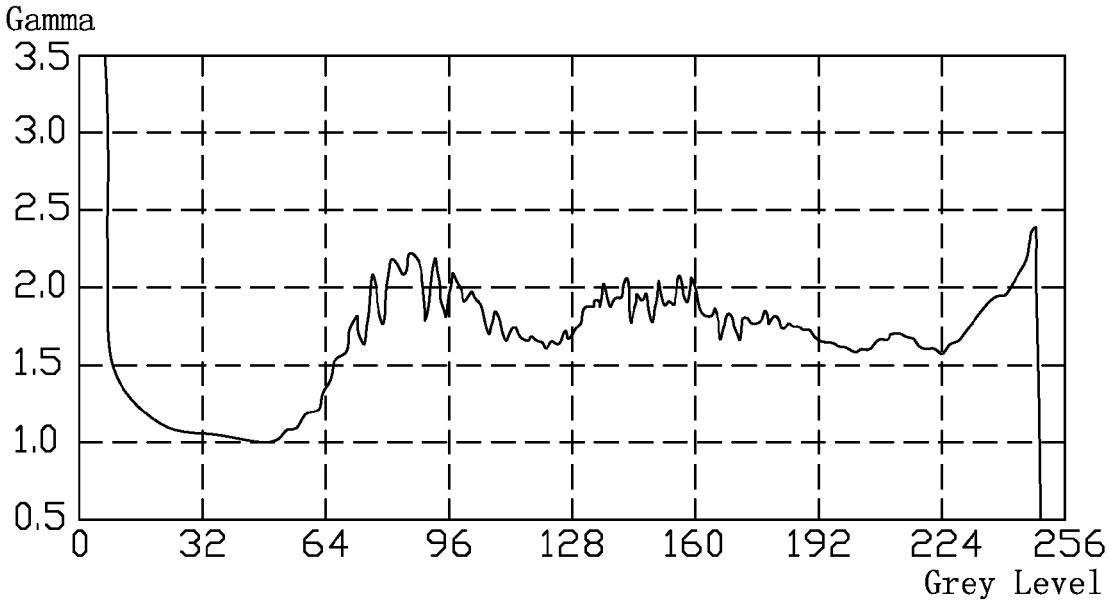
FIG. 5A is a curve diagram of a relationship between luminance and grey levels at 45 degrees side view angle of a flat display panel in two-dimensional (2D) display mode according to an exemplary embodiment of the disclosure.

In short, in the disclosure, at most three different electric potentials are provided for producing three different kinds of luminance in one pixel circuit, and thus can obtain better side view effect in two-dimensional (2D) display mode than the prior art. Referring to FIG. 5A, FIG. 5A is a curve diagram of a relationship between luminance and grey levels at 45 degrees side view angle of the flat display panel in two-dimensional (2D) display mode. By comparing FIG. 5A with FIG. 1, it can be found that the luminance curve resulting from executing the present embodiment is more closer to the curve of Gamma 2.2, i.e., achieving better improving effect.

Figure 5B:
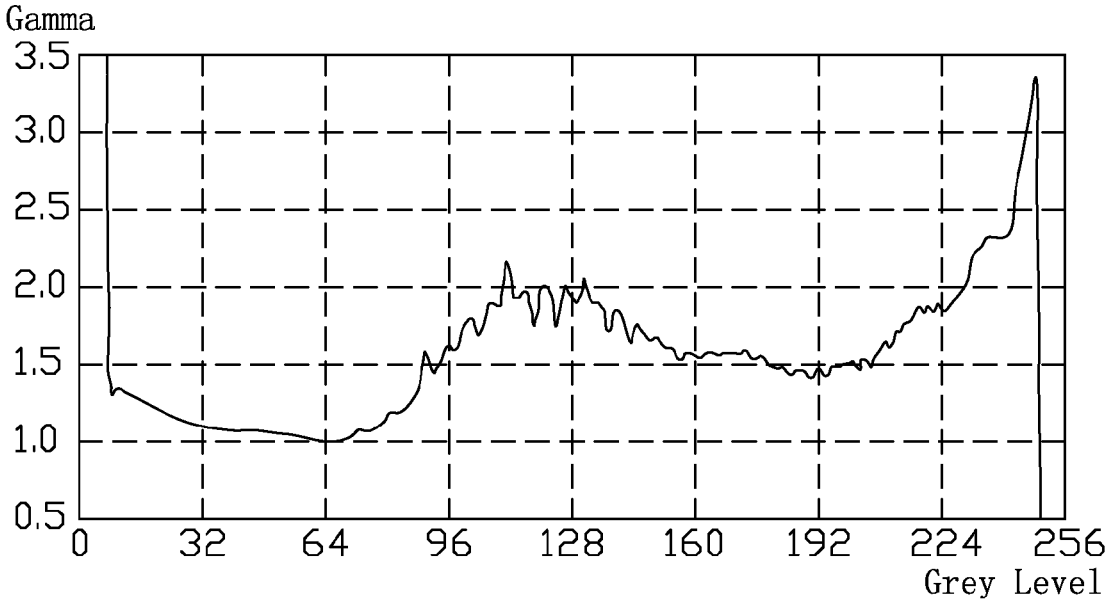
FIG. 5B is a curve diagram of a relationship between luminance and grey levels at 45 degrees side view angle of a flat display panel in three-dimensional (3D) display mode according to an exemplary embodiment of the disclosure.

In another aspect, in three-dimensional (3D) display mode, the first sub-electrode circuit can be turned off to be prevented from displaying data. On the other hand, in the 3D display mode, the pixel area A1 shown in FIG. 3 can be controlled to display approximately black by means of turning off the first sub-electrode control circuit. In this way, light leakage at side view angles can be decreased. Referring to FIG. 5B, FIG. 5 is a curve diagram of a relationship between luminance and grey levels at 45 degrees side view angle of the flat display panel in three-dimensional (3D) display mode. Similarly, the luminance curve shown in FIG. 5B is more closer to the curve of Gamma 2.2 than that shown in FIG. 1, which indicates that the present embodiment can also achieve better improving effect in 3D display mode than the prior art.

Besides the single-domain vertical alignment (VA) liquid crystal display device, if the present pixel circuit is adopted in a multi-domain vertical alignment (MVA) liquid crystal display device, the MVA liquid crystal display device may have a twelve-domain (i.e., four domains*three pixel areas) side view optical effect in 2D display mode, and may have eight-domain (i.e., four domains*two pixel areas) side view optical effect in 3D display modes. That is, the present pixel circuit can also improve side view optical effects of the MVA liquid crystal display device in both 2D and 3D display modes.

Figure 6:
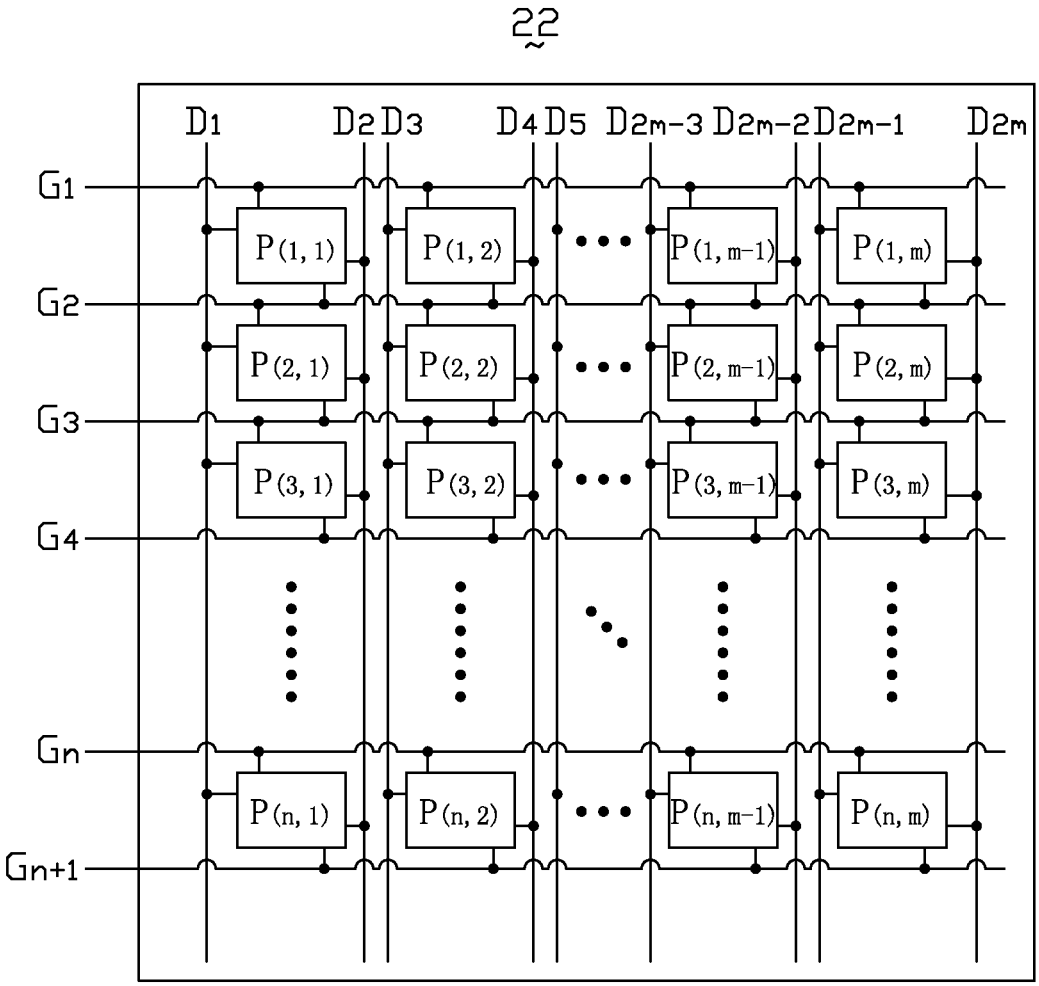
FIG. 6 is a schematic block diagram of a flat display panel according to another exemplary embodiment of the disclosure.

The aforementioned are several exemplary embodiments of the disclosure. It can be understood that, besides well-known modifications such as using other suitable switching elements to replace the transistors $T_1$, $T_2$, $T_3$ and $T_4$, the whole design of the flat display panels can also be modified. Referring to FIG. 6, FIG. 6 is a schematic block diagram of a flat display panel 22 according to another exemplary embodiment of the disclosure. As illustrated in FIG. 6, the circuit design of this embodiment is similar to that as shown in FIG. 2, the difference is that every two pixel circuits electrically coupled to the same two data lines in the flat display panel 20 shown in FIG. 2 are respectively electrically coupled to different scan lines, but in the flat display panel 22 as shown in FIG. 6, two adjacent pixel circuits electrically coupled to the same two data lines would share a same scan line.

For example, in FIG. 2 and FIG. 6, the two adjacent pixel circuits $P_{(1,1)}$ and $P_{(2,1)}$ are both electrically coupled to the data lines $D_1$ and $D_2$. However, in the flat display panel 20 as shown in FIG. 2, the pixel circuit $P_{(1,1)}$ is electrically coupled to the scan lines $G_1$ and $G_2$, and the pixel circuit $P_{(2,1)}$ is electrically coupled to the scan lines $G_3$ and $G_4$, that is, the scan lines electrically coupled to the pixel circuit $P_{(1,1)}$ are completely different from the scan lines electrically coupled to the pixel circuit $P_{(2,1)}$. In the flat display panel 22 shown in FIG. 6, besides the pixel circuit $P_{(1,1)}$ being electrically coupled to the scan line $G_1$ and the pixel circuits $P_{(2,1)}$ being electrically coupled to the scan line $G_3$, the pixel circuits $P_{(1,1)}$ and $P_{(2,1)}$ are both electrically coupled to the another scan line $G_2$. Compared with the circuit design of FIG. 2, the circuit design of FIG. 6 can decrease a great number of scan lines and thus is more suitable for practical use.

Furthermore, in the various embodiments of the disclosure, an area of the pixel area $A_1$ is A1, an area of the pixel area $A_2$ is A2, and an area of the pixel area $A_3$ is A3. When the areas A1, A2 and A3 is in accord with the following relationship that:

$$\frac{A1}{A1+A2+A3} \leq 30\%,$$

and A2≤A3, luminance curves at side view in both 2D and 3D display modes are more approximate to the curve of gamma 2.2 as shown in FIG. 5A and FIG. 5B, and accordingly better display quality can be achieved. Moreover, it is indicated that, the value of [A1/(A1+A2+A3)] is not limited to be in the range of no more than 30%, and may be in a broader range e.g., from 10% to 70% according to some experimental results.

Sum up, the disclosure can improve side view optical effects in both 2D and 3D display modes, and the improving effect of the disclosure exceeds that of the conventional method. Accordingly, the disclosure is more suitable for practical use in products.

While the disclosure has been described in terms of what is presently considered to be the most practical and preferred embodiments, it is to be understood that the disclosure needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A pixel circuit electrically coupled to successively arranged a first data line and a second data line and further electrically coupled to successively arranged a first scan line and a second scan line, the pixel circuit comprising:

a first sub-electrode control circuit electrically coupled to the first data line and the first scan line, the first sub-electrode control circuit for receiving data transmitted from the first data line and thereby controlling transparency of a first pixel area according to the received data from the first data line, the first sub-electrode control circuit comprising:

a first switching element;

a first sub-electrode electrically coupled to the first switching element; and a first storage capacitor electrically coupled to the first switching element through the first sub-electrode;

wherein the first switching element is electrically coupled between the first data line and the first storage capacitor and further electrically coupled to the first scan line, to thereby receive the data transmitted from the first data line and store the received data from the first data line in the first storage capacitor;

a second sub-electrode control circuit electrically coupled to the second data line and the first scan line, the second sub-electrode control circuit for receiving data transmitted from the second data line and thereby controlling transparency of a second pixel area according to the received data from the second data line, the second sub-electrode control circuit comprising:

a second switching element;

a second sub-electrode electrically coupled to the second switching element; and a second storage capacitor electrically coupled to the second switching element through the second sub-electrode;

wherein the second switching element is electrically coupled between the second data line and the second storage capacitor and further electrically coupled to the first scan line, to thereby receive the data transmitted from the second data line and store the received data from the second data line in the second storage capacitor; and a third sub-electrode control circuit electrically coupled to the second data line, the first scan line and the second scan line, the third sub-electrode control circuit for receiving the data transmitted from the second data line, changing the received data from the second data line by charge sharing subjected to the control of the second scan line and thereby controlling transparency of a third pixel area according to the changed data, the third sub-electrode control circuit comprising:

a third switching element;

a fourth switching element;

a third sub-electrode electrically coupled to the third switching element and the fourth switching element;

a third storage capacitor electrically coupled to the third switching element through the third sub-electrode; and a charge sharing capacitor electrically coupled to the fourth switching element;

wherein the third switching element is electrically coupled between the second data line and the third storage capacitor and further electrically coupled to the first scan line, to thereby receive the data transmitted from the second data line and store the received data from the second data line in the third storage capacitor;

wherein the fourth switching element is electrically coupled between the third storage capacitor and the charge sharing capacitor and further electrically coupled to the second scan line, to thereby control the third storage capacitor and the charge sharing capacitor to mutually share charges;

wherein a time of the second scan line being enabled is posterior to a time of the first scan line being enabled.

2. The pixel circuit according to claim 1, wherein the first pixel area, the second pixel area and the third pixel area are arranged between the first data line and the second data line, the first pixel area and the second pixel area are respectively arranged at two sides of the first scan line, and the second pixel area and the third pixel area are arranged between the first scan line and the second scan line.

3. The pixel circuit according to claim 1, wherein an area of the second pixel area is not larger than an area of the third pixel area.

4. The pixel circuit according to claim 1, wherein when the pixel circuit is used for three-dimensional display, the first sub-electrode control circuit is kept in a turned-off state.

5. A flat display panel comprising:

a plurality of scan lines;

a plurality of data lines; and a plurality of pixel circuits, at least one of the pixel circuits each electrically coupled to a first data line and a second data line arranged adjacent to the first data line among the plurality of data lines and further electrically coupled to a first scan line and a second scan line arranged adjacent to the first scan line among the plurality of scan lines; the at least one pixel circuit each comprising:

a first sub-electrode control circuit electrically coupled to the first data line and the first scan line and for receiving data transmitted from the first data line and controlling transparency of a first pixel area according to the received data from the first data line, the first sub-electrode control circuit comprising:

a first switching element;

a first sub-electrode electrically coupled to the first switching element; and a first storage capacitor electrically coupled to the first switching element through the first sub-electrode;

wherein the first switching element is electrically coupled between the first data line and the first storage capacitor and further electrically coupled to the first scan line, to thereby receive the data transmitted from the first data line and store the received data from the first data line in the first storage capacitor;

a second sub-electrode control circuit electrically coupled to the second data line and the first scan line and for receiving data transmitted from the second data line and controlling transparency of a second pixel area according to the received data from the second data line, the second sub-electrode control circuit comprising:

a second switching element;

a second sub-electrode electrically coupled to the second switching element; and a second storage capacitor electrically coupled to the second switching element through the second sub-electrode;

wherein the second switching element is electrically coupled between the second data line and the second storage capacitor and further electrically coupled to the first scan line, to thereby receive the data transmitted from the second data line and store the received data from the second data line in the second storage capacitor; and a third sub-electrode control circuit electrically coupled to the second data line, the first scan line and the second scan line and for receiving the data transmitted from the second data line, changing the received data from the second data line by charge sharing subjected to the control of the second scan line and thereby controlling transparency of a third pixel area according to the changed data, the third sub-electrode control circuit comprising:

a third switching element;

a fourth switching element;

a third sub-electrode electrically coupled to the third switching element and the fourth switching element;

a third storage capacitor electrically coupled to the third switching element through the third sub-electrode; and a charge sharing capacitor electrically coupled to the fourth switching element;

wherein the third switching element is electrically coupled between the second data line and the third storage capacitor and further electrically coupled to the first scan line, to thereby receive the data transmitted from the second data line and store the received data from the second data line in the third storage capacitor; and wherein the fourth switching element is electrically coupled between the third storage capacitor and the charge sharing capacitor and further electrically coupled to the second scan line, to thereby control the third storage capacitor and the charge sharing capacitor to share charges with each other;

wherein the second scan line and the first scan line are sequentially enabled, and the second scan line is enabled after the first scan line is enabled.

6. The flat display panel according to claim 5, wherein the first pixel area, the second pixel area and the third pixel area are arranged between the first data line and the second data line, the first pixel area and the second pixel area are respectively arranged at two sides of the first scan line, and the second pixel area and the third pixel area are arranged between the first scan line and the second scan line.

7. The flat display panel according to claim 5, wherein an area of the second pixel area is not larger than an area of the third pixel area.

8. The flat display panel according to claim 5, wherein when the flat display panel is used for three-dimensional display, the first sub-electrode control circuit is kept in a turned-off state.

9. The flat display panel according to claim 5, wherein every two of the plurality of pixel circuits that are both electrically coupled to the first data line and the second data line are electrically coupled to different ones of the plurality of scan lines.

10. The flat display panel according to claim 5, wherein adjacent two of the plurality of pixel circuits that are both electrically coupled to the first data line and the second data line share a same one of the plurality of scan lines.

11. A flat display panel being operative in two-dimensional display mode and three-dimensional display mode and comprising:

a plurality of scan lines;

a plurality of data lines; and a plurality of pixel circuits, at least one of the pixel circuits each electrically coupled to neighboring two of the data lines and neighboring two of the scan lines to thereby receive data transmitted from the neighboring two data lines and share charges subjected to the control of the neighboring two scan lines for image display;

wherein the at least one pixel circuit each is divided into a plurality of pixel areas, and one of the pixel area is prevented from displaying data in the three-dimensional display mode rather than the two-dimensional display mode, the at least one pixel circuit each comprising:

a first sub-electrode control circuit electrically coupled to a first data line and a first scan line and for receiving data transmitted from the first data line and controlling transparency of a first pixel area according to the received data from the first data line, the first sub-electrode control circuit comprising:

a first switching element;

a first sub-electrode electrically coupled to the first switching element; and a first storage capacitor electrically coupled to the first switching element through the first sub-electrode;

wherein the first switching element is electrically coupled between the first data line and the first storage capacitor and further electrically coupled to the first scan line, to thereby receive the data transmitted from the first data line and store the received data from the first data line in the first storage capacitor;

a second sub-electrode control circuit electrically coupled to a second data line and the first scan line and for receiving data transmitted from the second data line and controlling transparency of a second pixel area according to the received data from the second data line, the second sub-electrode control circuit comprising:

a second switching element;

a second sub-electrode electrically coupled to the second switching element; and a second storage capacitor electrically coupled to the second switching element through the second sub-electrode;

wherein the second switching element is electrically coupled between the second data line and the second storage capacitor and further electrically coupled to the first scan line, to thereby receive the data transmitted from the second data line and store the received data from the second data line in the second storage capacitor; and a third sub-electrode control circuit electrically coupled to the second data line, the first scan line and a second scan line and for receiving the data transmitted from the second data line, changing the received data from the second data line by charge sharing subjected to the control of the second scan line and thereby controlling transparency of a third pixel area according to the changed data, the third sub-electrode control circuit comprising:

a third switching element;

a fourth switching element;

a third sub-electrode electrically coupled to the third switching element and the fourth switching element;

a third storage capacitor electrically coupled to the third switching element through the third sub-electrode; and a charge sharing capacitor electrically coupled to the fourth switching element;

wherein the third switching element is electrically coupled between the second data line and the third storage capacitor and further electrically coupled to the first scan line, to thereby receive the data transmitted from the second data line and store the received data from the second data line in the third storage capacitor;

wherein the fourth switching element is electrically coupled between the third storage capacitor and the charge sharing capacitor and further electrically coupled to the second scan line, to thereby control the third storage capacitor and the charge sharing capacitor to share charges with each other; and wherein the second scan line and the first scan line are sequentially enabled, and the second scan line is enabled after the first scan line is enabled.

* * * * *